United States Patent [19]

Williams

[11] 3,946,207

[45] Mar. 23, 1976

[54] TIME CARD COMPUTER

[76] Inventor: Henry J. Williams, P.O. Box 322, Rose Hill, N.C. 28458

[22] Filed: Nov. 30, 1973

[21] Appl. No.: 420,373

[52] U.S. Cl. ..... 235/88 M; 235/78 M; 235/83

[51] Int. Cl.[2] ..... G06C 3/00; G06C 27/00

[58] Field of Search ..... 235/88, 83, 84, 78, 70 A

[56] References Cited

UNITED STATES PATENTS

| | | | |
|---|---|---|---|
| 1,397,944 | 11/1921 | Dalzell | 235/88 |
| 1,471,341 | 10/1923 | Lamb | 235/88 |
| 2,404,709 | 7/1946 | Hill | 235/78 |
| 2,429,212 | 10/1947 | Batori | 235/84 |
| 3,013,720 | 12/1961 | Steinkoenig | 235/78 |
| 3,044,698 | 7/1962 | Maluf | 235/83 |

*Primary Examiner*—Stephen J. Tomsky
*Attorney, Agent, or Firm*—Mills & Coats

[57] ABSTRACT

The present invention relates to a time card computer that is adapted to compute or calculate the total time worked by a worker over a specified time period and in the process compensates or subtracts for interim time out periods. The time card computer of the present invention is of the circular or disc type and includes a stationary total time worked scale, a movable time reference scale disposed radially inward of said total time worked scale and a movable time out or subtracting scale disposed radially inwardly of said time reference scale.

In computing the total time worked by a worker over a specified period of time, the time reference and time out scales are indexed relatively to the stationary total time worked scale. In computing the total time worked over a specified period of time, the total time worked scale and time out scale are so scaled that equal increments of time inscribed upon each corresponds such that the total time worked appears on the total time worked scale opposite the final stopping time on the time out scale. To compensate for time out periods that occur within the specified time periods, the time out scale can be moved relative to the time reference scale which effectively subtracts the time of any interim time out period.

1 Claim, 5 Drawing Figures

FIG. 3
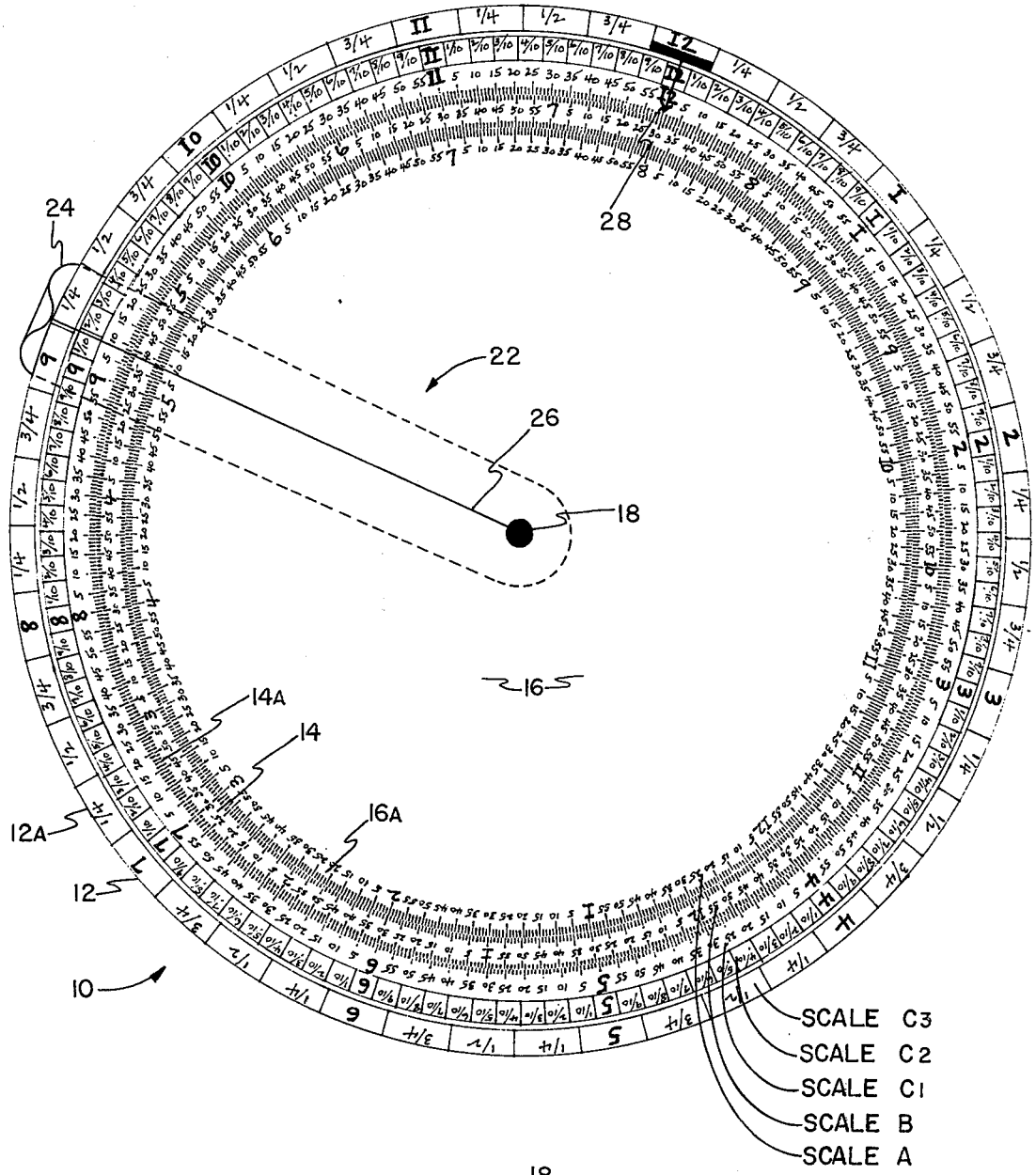
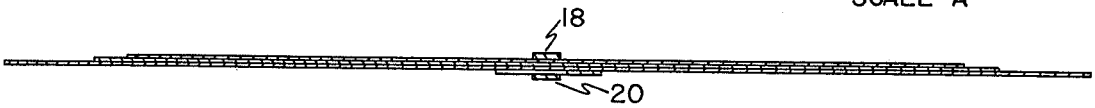
FIG. 4

TIME CARD COMPUTER

The present invention relates to time calculators and more particularly to time calculators of the circular or disc type having sliding time incremented scales associated therewith.

Today the "punch-in and punch-out" time clock is widely used by employers in keeping accurate daily time records of employees. Although such has and continues to be an effective and efficient means of recording time worked, nevertheless there always remains the difficult and time consuming task of converting the starting and stopping times between breaks and time outs in to actual hours worked. In this regard, the "time outs or breaks" especially are troublesome in that they require converting the start-stop times into actual hours worked and then adding the actual hours worked before and after the time out to arrive at the total time worked for a certain period of time.

In view of the difficulty in converting start-stop times into actual hours worked and compensating for any interim time out periods, the present invention has been devised and presents a time computing calculator in the form of a circular or disc type slide calculator. Basically, the time calculator of the present invention comprises three basic scales: (1) a total time worked scale having an index point and consecutive time increments inscribed around the scale; (2) a time reference scale disposed adjacent the total time worked scale and including daily time increments inscribed thereon and extending along side the various time increments on said total time worked scale; and (3) a "time out" subtracting scale having daily increments of time corresponding to the increments of time on said time reference scale inscribed thereon, the daily time increments of both the time out and time reference scales being disposed adjacent each other and both scales being movable relative to said total time worked scale.

Generally, the circular or disk type time computer is utilized by ascertaining the start time and moving the time reference and time out scales to where the ascertained start time is aligned with the index point on said total time worked scale. Next, the stopping and starting times between a "time out" or "break" is ascertained. The time out scale is then moved relative to the time reference scale to where the starting time after the time out on the time out scale aligns with the stopping time before the time out on the time reference scale. The effect of this is that the elapsed time during the time out is effectively substantial because of the proper scaling of the time reference and time out scales. Finally, the final stopping time is ascertained by using an indicating pointer, radius hairline or simply from close observation, the total hours worked over the particular time period is indicated on the total time worked scale opposite the final stopping time on the time out scale. Consequently then, it is seen that the slide or disc type calculator of the present invention allows one to readily ascertain the total hours worked over a specified period of time given the respecting starting-stopping times, and allows the user thereof to readily subtract "time out" or "break" periods by mechanical adjusting the time reference and time out scales.

It is, therefore, an object of the present invention to provide a time calculator that is adapted to compute the actual total worked time of a worker over a specified period of time compensating or deducting the "time out" or "break" periods during the specified time.

A further object of the present invention resides in the provision of a time computer for computing the actual worked time of a worker over a specified period of time wherein the time computer is of a circular or disc type sliding scale instrument.

Still a further object of the present invention is to provide a time computer for converting the starting and stopping times of a worker over a specified period of time into actual total hours worked during that time, and to provide means for compensating or deducting for time out or break periods that may occur during the specified period of time.

A further object of the present invention is to provide a time computer that is simple to operate, relatively inexpensive, and readily lends itself to conventional means of recording starting-stopping times of a worker over a specified period of time.

Still a further object of the present invention is to provide a time computer that is adapted to compute total time worked giving the respective starting-stopping times of a worker, and wherein the computer is so scaled such that the total time worked can be determined to the nearest minute, thereby giving rise to an extremely accurate and precise time computing instrument.

Other objects and advantages of the present invention will become apparent and obvious from a study of the following description and accompanying drawings.

DESCRIPTION OF THE DRAWINGS

FIG. 3 shows the same time calculator illustrating a third example of computing actual time worked from a third given set of start-stop times.

FIG. 4 is a cross sectional view of the time calculator shown in FIG. 1 taken along the lines 4—4 of FIG. 1.

DESCRIPTION OF THE PREFERRED EMBODIMENT

Figure 1:
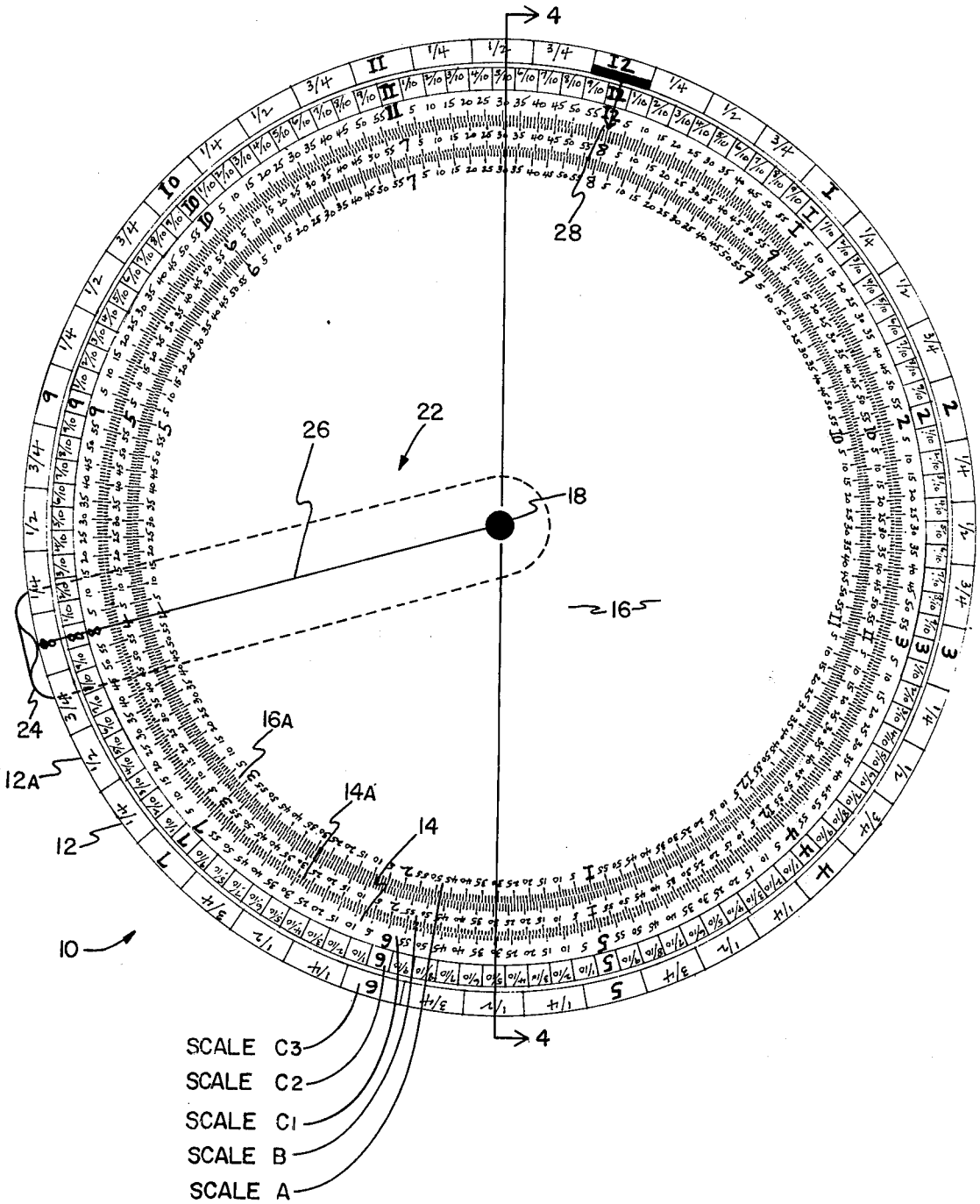
FIG. 1 is a top plan view of the multi-scale time calculator of the present invention illustrating a first example of computing actual time worked from a given set of start-stop times.

With reference to the drawings, the circular or disc type time calculator of the present invention is shown therein and indicated generally by the numeral 10. Viewing the disc type calculator type 10 in greater detail, it is seen that the same comprises a base disc 12 having an outer terminal circular edge 12a, an intermediate disc 14 having an outer terminal circular edge 14a, and an inner disc 16 having an outer circular terminal edge 16a.

The base disc 12, intermediate disc 14, and inner disc 16 are all three concentrically oriented and secured together in overlying relationship by a pivot pin 18 extending axially through each and having a retaining nut 20 secured to one end thereof adjacent the back side of the base disc 12. Therefore, it is appreciated that the base disc 12 is generally stationary, while the intermediate and outer discs 14 and 16, respectively, can be rotated about the axis of the pivot pin 18.

Pivotably mounted about pivot pin 18 is a radius sliding indicator arm 22, the radius arm 22 extending from the center of the time calculator 10 radially outwardly across all three discs 12, 14 and 16. Sliding indicator 18 basically comprises a back arm 24 pivotably mounted about pivot pin 22 and extending adjacent the back side of the base disc 12. The outer edge of the back arm 24 is turned up and has a hairline 26 fixed thereto and extending inwardly therefrom where the inner end of the hairline pivots about the axis of the pivot pin 18. It will be appreciated by those skilled in the art that the radius arm 22 could include a clear plastic arm like member about the top side of the time computer 10 with the hairline 26 incubed thereon.

Inscribed circumfentially about the outer portion of the base disc 12 is a series of stationary scales denoted $C_1$, $C_2$ and $C_3$. All three of these C scales are what is referred to as total time worked scales and only differ in the number of equal time graduations between even hourly marks.

More specifically, each C scale includes an index point 28 and 12 hourly divisions inscribed around the respective scale; the hourly divisions beginning at 1 and continuing consecutively clockwise, as viewed in FIGS. 1–3, to 12. It is seen that the 12th hourly division coincides with the index point 28. Scale $C_3$, the outer scale on disc 12 is divided into quarter hour segments between respective hourly divisions. Scale $C_2$, the intermediate stationary actual time worked scale, is divided into tenths of hours between respective hourly divisions. Finally Scale $C_1$, the inner scale on disc 12, is divided into minutes (1/60 hr.) between respective hourly divisions. Thus, it is appreciated that by using Scales $C_1$, $C_2$, or $C_3$ actual worked time can be determined to the nearest quarter-hour, tenth hour or minute.

Inscribed circumfentially around the outer face edge of the intermediate disc 14 is Scale B which is referred to as a "Time Reference" scale. Scale B includes daily time increments that range from 1 to 12, these time increments representing daily hourly time. Between each hour of time there are sixty (60) equal divisions, each division representing one minute of time.

Finally, inscribed circumfentially about the outer face edge of the inner disc 16 is Scale A which corresponds to Scale B. Scale A is referred to as a "time out" scale since it is used in conjunction with Scale B to compensate for time out periods of a worker during the specified working day or period.

Viewing all scales together it is noted that each scale is so scaled that equal increments of time occupy the same radial angle. Expressed differently, 15 minutes on either scale correspond to 15 minutes on any other scale.

OPERATION

With reference to FIG. 1 and Example 1, assume that an employee began work at 8:00 o'clock A.M., and stopped working at 4:00 o'clock P.M., and had no time out periods. To determine the total actual worked time, Scales A and B would be moved to where the starting time (8:00 o'clock A.M.) aligned with the index point 28 (FIG. 1). Next the radius arm 22 is moved to where it aligns with the stopping time (4:00 o'clock P.M.) on Scale A, the time out scale. The computed total worked time is 8 hours indicated on either Scales $C_1$, $C_2$, or $C_3$ under the hairline 26.

FIG. 3 illustrates a second example of computing actual time worked by a worker over a specified period of time. In this example, assume that the employee begun work at 7:30 o'clock A.M. and stops at 5:08 o'clock P.M., taking out 30 minutes for lunch from 12:30 P.M. to 1:00 o'clock P.M. To determine the total actual time worked from 7:30 o'clock A.M. to 5:08 o'clock P.M., both scales A and B would be moved such that the starting time of 7:30 o'clock A.M., appearing on each, would be aligned with the index point 28 on the stationary C scales. Scale A would then be moved counterclockwise, as viewed in FIG. 3, until the 1:00 o'clock reading thereon was aligned with the 12:30 o'clock reading on Scale B, this scale manipulation being done while carefully holding scale B stationary. Thus, it can be seen that the effect of moving Scale A relative to Scale B is to subtract the time out period between 12:30 o'clock P.M. and 1:00 o'clock P.M. Finally, to determine the total actual time worked between 7:30 o'clock A.M. and 5:08 o'clock P.M., the radius arm 22 is moved to where the hairline 26 aligns with the stopping time 5:08 o'clock P.M. on scale A. Now, the total worked time can be found opposite the hairline on either one of the C scales, and can, therefore, be read to the nearest quarter hour, tenth hour, or minute.

Figure 2:
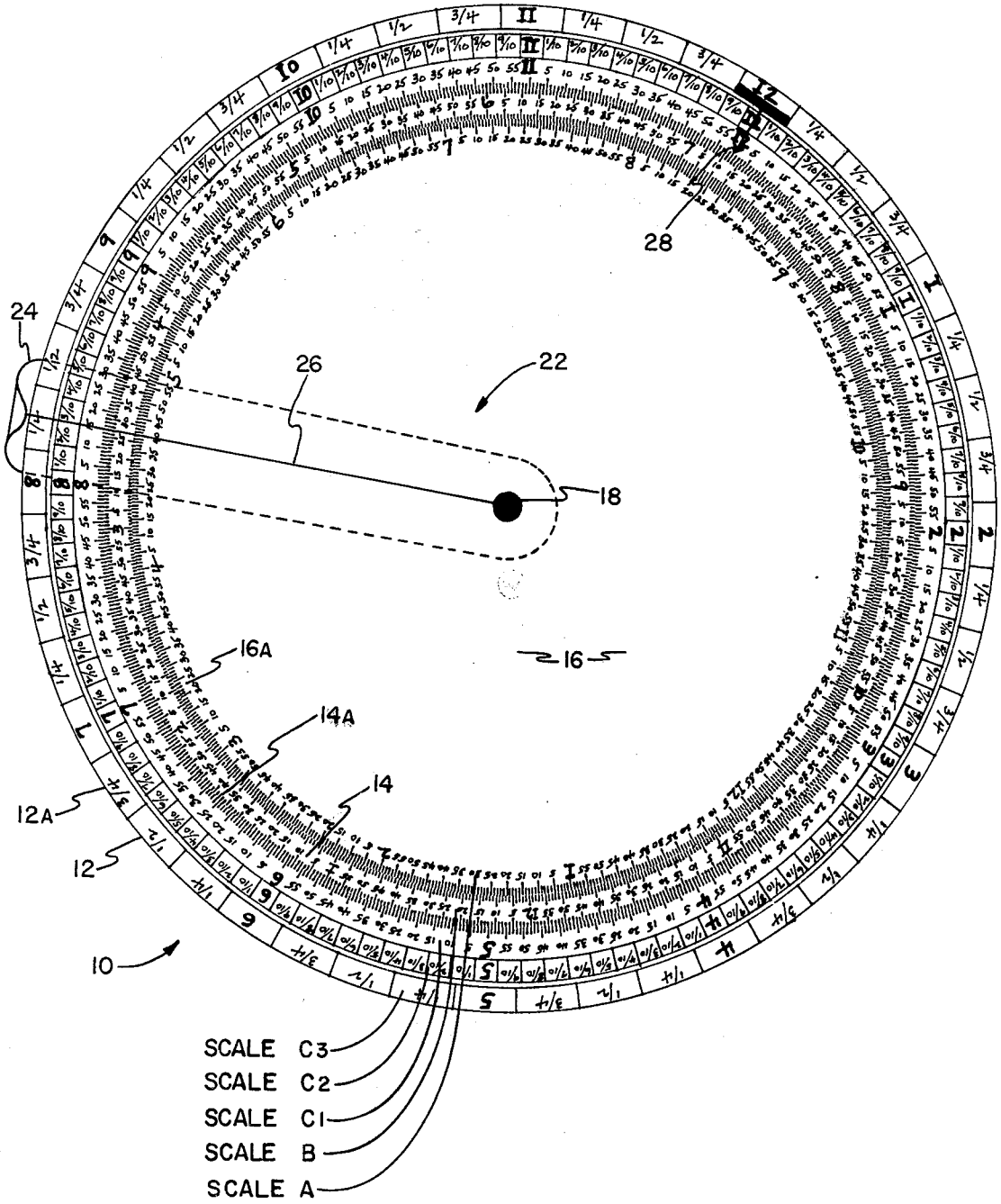
FIG. 2 is also a top plan view of the same time calculator illustrating a second example of computing actual time worked from a given set of start-stop times.
Figure 5:
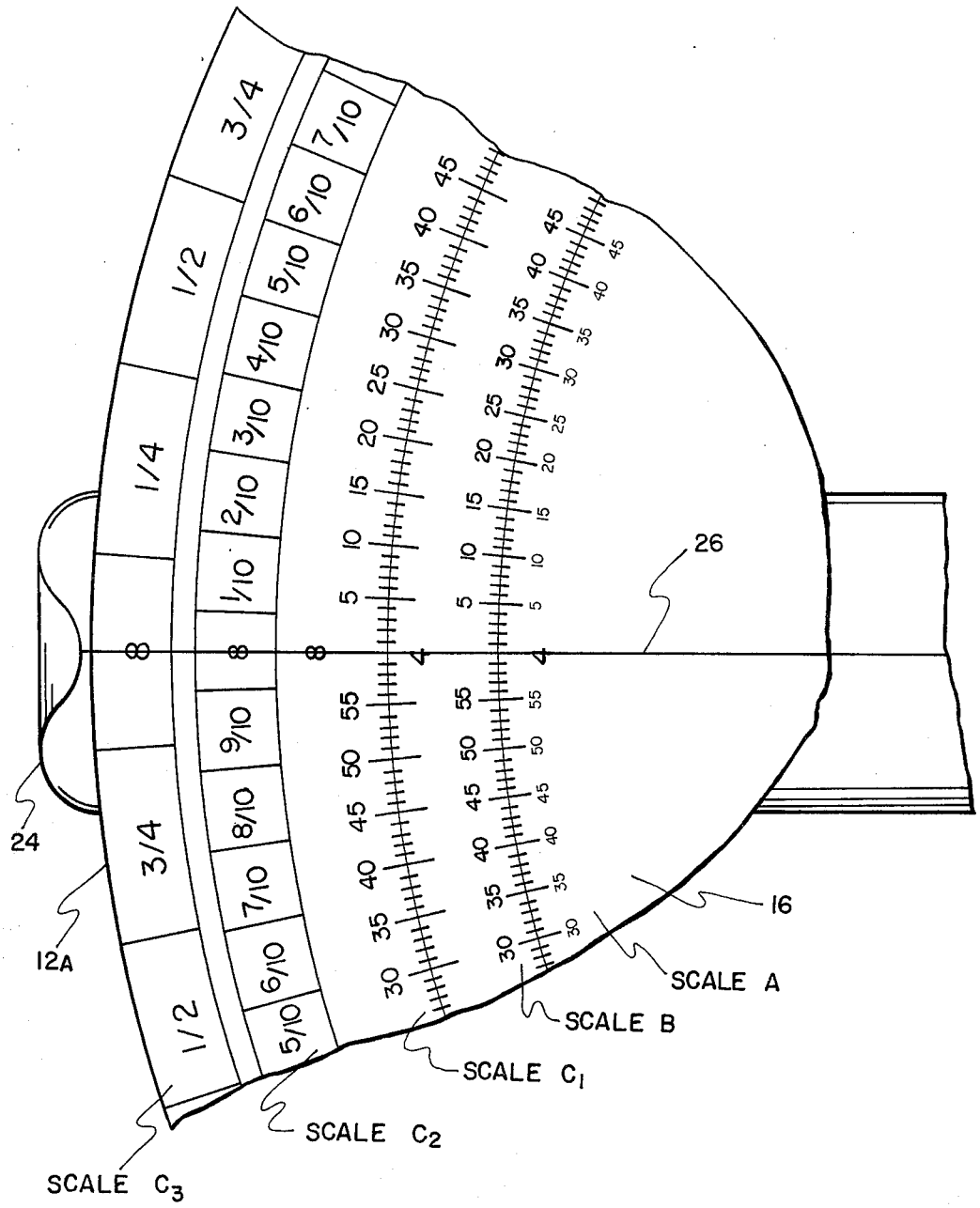
FIG. 5 is an enlarged fragmentary plan view of a portion of the multi-scale time calculator shown in FIG. 1, this enlarged fragmentary view particularly illustrating the relationship of the various radially spaced scales on a larger scale.

Lastly, turning to FIG. 2 and a third example of computing the time over a specified period of time, assume that the employee began work at 7:12 o'clock A.M., and stopped work at 5:40 o'clock P.M. Also, assume that the employee punched out for lunch at 11:53 o'clock A.M., and punched in after lunch at 1:06 o'clock P.M. To determine the total actual hours worked between the starting time 7:12 o'clock A.M. and the final stopping time 5:40 o'clock P.M., scales A and B would be indexed relative to the C scales such that the starting time of 7:12 o'clock A.M., on both scales A and B are aligned with the index point 28. Scale A would then be rotated counterclockwise, as viewed in FIG. 2, until the start back time of 1:06 o'clock on Scale A is opposite the stop time (before the time out) of 11:53 o'clock on Scale B. As can be appreciated, this has the effect of subtracting the hour and 13 minutes taken out for lunch. To determine the total actual worked hours then between 7:12 o'clock A.M. and 4:40 o'clock P.M., the sliding radius indicator 22 is moved to where the hairline 26 thereof aligns with 4:40 o'clock, the final stopping time, on Scale A and the total worked time appears on Scale $C_3$ as 8¼ hours, on Scale $C_2$ as 8.2 hours, and on Scale $C_1$ as 8 hours 15 minutes.

From the foregoing, it is apparent that the circular time calculator of the present invention has the advantage of being easy and simple to operate while providing a precise and accurate means for computing time over a selected work day. Another principal advantage of the time computer of the present invention is its ability to compensate for "time out" periods that may occur during the work day. By taking into account these time out periods, the user of the time computer of the present invention can determine the total hours worked for a day by simply knowing the beginning or starting time and the final stopping time, and the starting and stopping times of any time outs or breaks. The use of the time computer enables the user to compute the time to the nearest quarter hour, the nearest tenth of an hour, or to the nearest minute without having to convert hours to quarter hours or to tenths of hours or to minutes; and allows the user to compute the total worked time without having to first determine the total time worked prior to break, the total work subsequent to a break, and then having to add the two and make whatever conversions are necessary to come up with the final total hours worked.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A multi-scale circular disc time computer comprising: a first circular disc having three separate radially spaced total time worked scales inscribed thereon, said total time worked scales including a first circular scale divided into minute increments, a second circular scale divided into tenth-hour increments and a third scale divided into quarter-hour increments; a second circular disc rotatively mounted above said first circular disc about an axis that is concentric with said total time worked scale, and wherein the outer peripheral edge of said second circular disc is spaced radially inwardly from at least one total time worked scale inscribed on said first circular disc, and wherein said second circular disc includes a reference time scale having consecutive minute increments of time circumferentially inscribed about a circular path on the front outer side thereof inwardly of the outer peripheral edge of said second circular disc such that when selectively set and viewed together equal increments of time on said time reference and total time worked scales are radially aligned; a third circular disc centrally disposed over said first and second discs and of a less diameter than either, said third circular disc being rotatively mounted about the same axis as said second circular disc and having an outer peripheral edge spaced inwardly of said time reference scale inscribed on said second circular disc, said third circular disc having a time out scale including minute increments of time corresponding to increments of time on said time reference scale circumferentially disposed about the front outer portion thereof whereby the total actual worked time may be calculated by moving either said reference time scale relative to said time out scale or vice versa to effectively subtract "time-out," and reading the actual time worked for a specified period indicated on any one of said total time worked scales opposite the stop time on the particular scale moved; and a radius indicating arm pivotably mounted about the axis of said first and second circular discs and extending radially therefrom over said first, second and third circular discs and the various scales inscribed on such discs, said radius arm including a back arm pivotally mounted about the axis of said first and second circular discs and extending radially therefrom adjacent the back side of said first circular disc, and wherein said back arm includes a turned outer end that generally extends around the outer periphery of said first circular disc, and a hairline extending radially inwardly from said outer turned end to said axis and aligned with said back arm and movable therewith as said back arm is pivoted about its axis of rotation.

* * * * *